US009228299B2

(12) United States Patent
Brown

(10) Patent No.: US 9,228,299 B2
(45) Date of Patent: Jan. 5, 2016

(54) PERVIOUS PAVING MAT WITH RAISED TEETH

(71) Applicant: Brian Brown, Duluth, MN (US)

(72) Inventor: Brian Brown, Duluth, MN (US)

( * ) Notice: Subject to any disclaimer, the term of this patent is extended or adjusted under 35 U.S.C. 154(b) by 0 days.

(21) Appl. No.: 14/449,635

(22) Filed: Aug. 1, 2014

(65) Prior Publication Data

US 2015/0056013 A1 Feb. 26, 2015

Related U.S. Application Data

(60) Provisional application No. 61/868,875, filed on Aug. 22, 2013.

(51) Int. Cl.

| | |
|---|---|
| ***E01C 11/22*** | (2006.01) |
| ***E01C 5/18*** | (2006.01) |
| ***E01C 5/20*** | (2006.01) |
| ***E01C 5/00*** | (2006.01) |

(52) U.S. Cl.

CPC ..... *E01C 5/005* (2013.01); *E01C 11/225* (2013.01); *E01C 5/18* (2013.01); *E01C 5/20* (2012.01)

(58) Field of Classification Search

CPC ..... E01C 5/20; E01C 5/00; E01C 5/005; E01C 5/18; E01C 9/086; E01C 9/08; E01C 11/225

USPC ..... 404/35, 36

See application file for complete search history.

(56) References Cited

U.S. PATENT DOCUMENTS

| | | | | |
|---|---|---|---|---|
| 2,876,628 | A * | 3/1959 | Dixon, Jr. | 405/20 |
| 3,846,945 | A * | 11/1974 | Roby | 52/177 |
| 4,375,928 | A * | 3/1983 | Crow et al. | 405/20 |
| 5,632,571 | A * | 5/1997 | Mattox | 405/19 |
| 5,833,386 | A * | 11/1998 | Rosan et al. | 404/36 |
| 6,416,253 | B1 * | 7/2002 | Wimp et al. | 405/172 |
| 6,612,776 | B1 * | 9/2003 | Jansson | 405/20 |
| 6,696,122 | B1 * | 2/2004 | Deschamps | 428/36.1 |
| 7,048,469 | B1 * | 5/2006 | Jansson | 405/20 |
| 8,459,896 | B2 * | 6/2013 | Buch | 404/29 |
| 8,784,001 | B1 * | 7/2014 | Phillips et al. | 404/35 |
| 2005/0191126 | A1 * | 9/2005 | Amelung, Sr. | 404/36 |
| 2015/0043970 | A1 * | 2/2015 | Dressler et al. | 404/36 |

* cited by examiner

*Primary Examiner* — Abigail A Risic

(74) *Attorney, Agent, or Firm* — Greg N. Geiser; Geiser Law, PLLC

(57) ABSTRACT

A permeable paving mat for installation onto a surface. The mat includes a top side, a bottom side, a notched side, and a continuous side, and is composed of shapes forming a structure. The top side includes a series of groves at the edges of the shapes with the corner of the shapes including an aperture to allow for the infiltration of water from the top side. The notched side secures to an adjacent notched side through interlocking with the continuous side including a plurality of through holes to receive a fiberglass rod. The continuous sides are secured to each other by using an extended rod. The bottom side of the shapes are frustum shaped to provide a raised surface.

8 Claims, 5 Drawing Sheets

PERVIOUS PAVING MAT WITH RAISED TEETH

CROSS REFERENCE TO RELATED APPLICATIONS

This application claims the benefit of provisional patent application Ser. No. 61/868,875 filed 2013 Aug. 22 by the above named inventor, and is herein incorporated by reference in its entirety.

FEDERALLY SPONSORED RESEARCH OR DEVELOPMENT

Not Applicable

SEQUENCE LISTING, A TABLE, OR A COMPUTER PROGRAM

Not Applicable

FIELD OF THE INVENTION

The present invention relates to an interlocking permeable paving mat.

BACKGROUND OF THE INVENTION

Permeable pavement is a type of paving treatment that allows water to seep into the ground below the paving surface. Allowing the water to flow through the pavement prevents the runoff of water into storm drains and waterways and results in a positive environmental impact. The water moving through the permeable paving has its contaminants removed as it is slowly filtered through the aggregate present in the ground and eventually replenishes the underlying aquifers. Additionally, the resulting prevention of the pooling and flowing away of storm water into nearby bodies of water improves their clarity, temperature, and promotes a healthy ecosystem.

Permeable pavement, also known as porous or pervious, is available in several structures and forms. Permeable pavement can be installed in a continuous form as pervious concrete or porous asphalt or in a discontinuous form as pavers, mats, or open-celled pavers. Each of these forms of permeable paving has benefits and conversely drawbacks. These drawbacks are often related to performance, installation ease, longevity, and durability.

Therefore, there is a need for a pervious paving product that allows for adequate inflow of water, is easily installed and durable. Preferably, this product has multiple uses and is able to be configured and installed in multiple location types.

SUMMARY OF THE INVENTION

An interlocking pervious paving mat adapted for installation onto a surface to provide a permeable paving solution. The paving mat is designed to replace traditional paving methods such as concrete, asphalt, and paving block, with a permeable paving solution for the replacement of driveways, walkways, playground areas, and boat landing areas. The pervious mat includes a top side, a bottom side, a pair of notched ends, and a pair of continuous ends. The mat is constructed out of a grid of individual shapes molded together. Each edge of the shape includes a groove with the corner of each shape marking the location of an aperture. The aperture is located within the groove and extends a thickness of the mat from the top side to the bottom side. The aperture allows water on the top side to flow to the underside of the mat and enter the ground below an installed mat. The grooves facilitate the flow of water towards the apertures and allow water to move off of the surface of the top side.

The pair of continuous ends are configured on opposed sides of the mat with the continuous ends arranged adjacent to the notched ends. The pair of notched ends are on opposed sides of the mat. The notched ends are formed from an alternating of the pattern of the mat with the opposed notched ends designed to intermesh in a cohesive pattern. In use, the notched ends interlock together to allow for the attachment of multiple mats together to form an integral and complete paving surface.

A plurality of through holes are centrally located on the thickness of the mat and extend a width of the mat parallel to the notched ends. The through holes are continuous throughout the width extending from each end of the pair of continuous ends. The through holes are evenly spaced across the mat dimensions and allow for the insertion of a fiberglass rod. In installation, the fiberglass rod is fed into the through hole of the mat and any adjacent mats stretching along a length of the installation area. Due to the extended length of the fiberglass rod and its inherent material properties, the fiberglass rod creates stability across mats as they are installed adjacently.

The bottom side of the mat is formed from the underside of the shapes. The underside of these shapes form a frustum with the bottom most point of the underside of the shapes flat and having an area less than the area of the top side of the shapes. The shape sides are tapered to create this frustum shape. In appearance the bottom side has a raised profile with large grooves forming an aggressive tread surface. The bottom side frustum shape has the ability to grip the installation surface, provide increased flexibility, and aid in the permeability of the mat. Further, the frustum shape on the bottom side of the mat, allows for movement during frost/freeze/thaw cycles.

Preferably, the mat is constructed out of a blend of recycled rubber and plastic materials and provided in a dimension of thirty-two (32) inches wide by forty (40) inches long. According to these dimensions, the mat is comprised of a grid of squares with a side length of four (4) inches. Although plastic and rubber are the preferred construction materials, the mat may be enhanced by the addition of additional materials such as, fibers, sawdust, stone, or other recycled materials to enhance traction, de-icing, or weed control. Due to its permeable and recycled material properties, it is expected that the mat would qualify for LEED (Leadership in Energy and Environmental Design) credits.

To install the mat, the surface to be paved is prepared. This preparation may consist of leveling the ground to be paved and first laying a surface of a coarse compacted substrate, such as class five (5) gravel or recycled concrete. The appropriate number of mats to cover the given area is selected. The mats are then installed by interlocking the notched ends and aligning the through holes. The fiberglass rods are then threaded into the through holes and cut to the appropriate length. The mat structure is then placed onto the underlying surface with the bottom side adjacent to the underlying surface.

BRIEF DESCRIPTION OF THE SEVERAL VIEWS OF THE DRAWING(S)

The accompanying drawings are included to provide a further understanding of the present invention and are incorporated in and constitute a part of this specification. The drawings illustrate exemplary embodiments of the present invention and together with the description serve to further explain the principles of the invention. Other aspects of the invention and the advantages of the invention will be better appreciated as they become better understood by reference to the Detailed Description when considered in conjunction with accompanying drawings, and wherein.

DETAILED DESCRIPTION OF THE INVENTION

Figure 1:
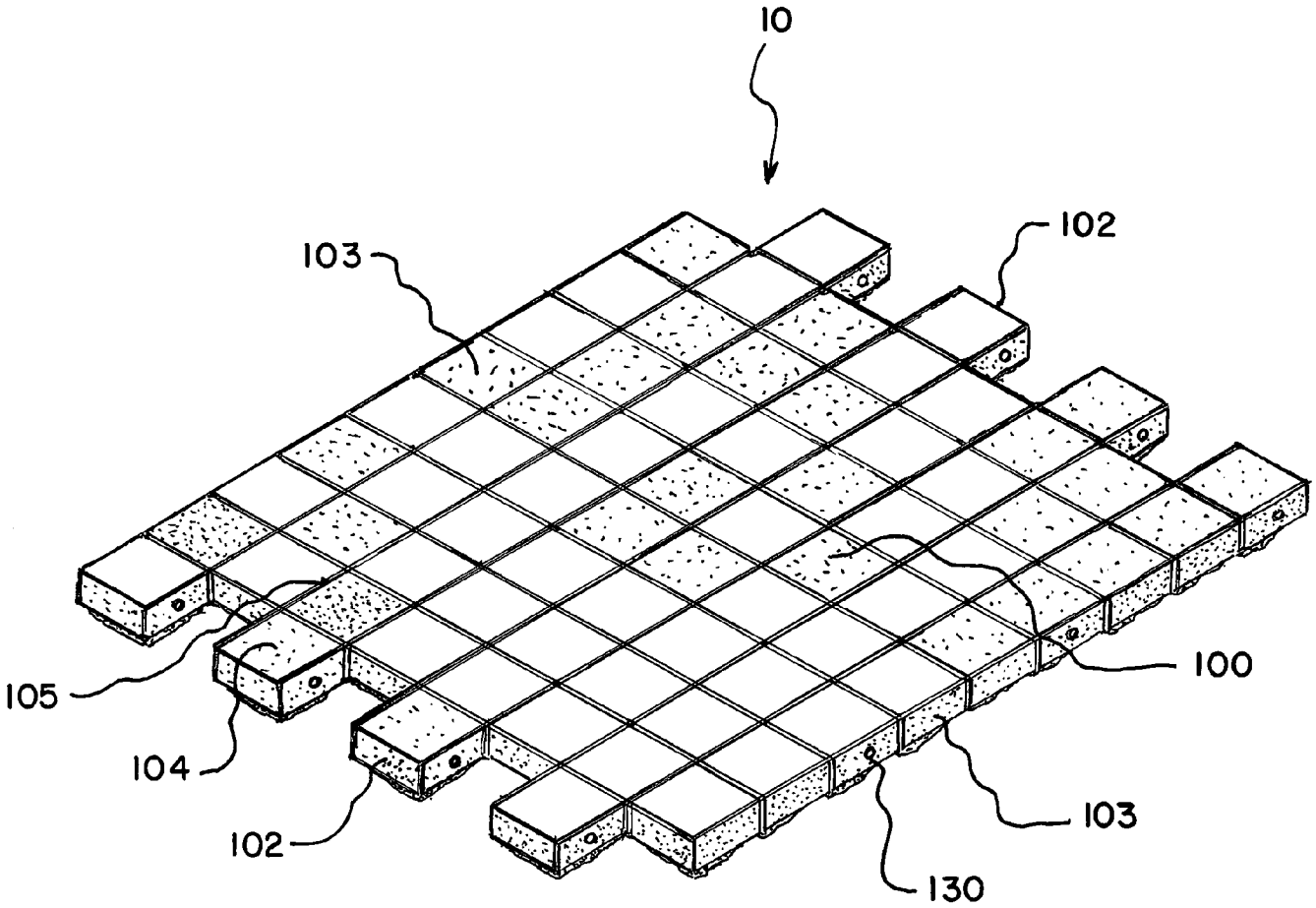
FIG. 1 is an isometric view of a top side of the mat, according to the present invention.
Figure 2:
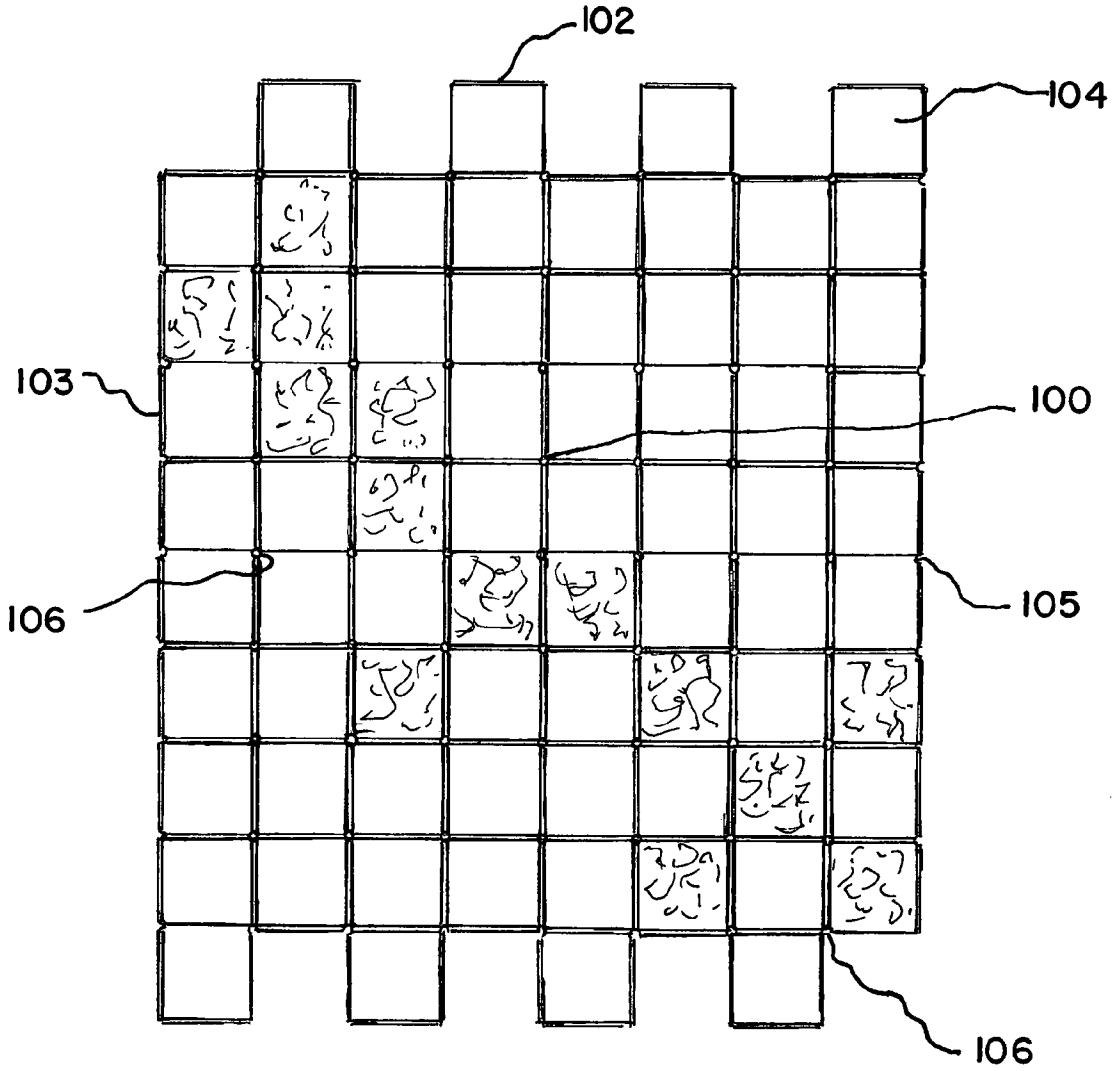
FIG. 2 is a top plan view of the mat, according to the present invention.
Figure 3:
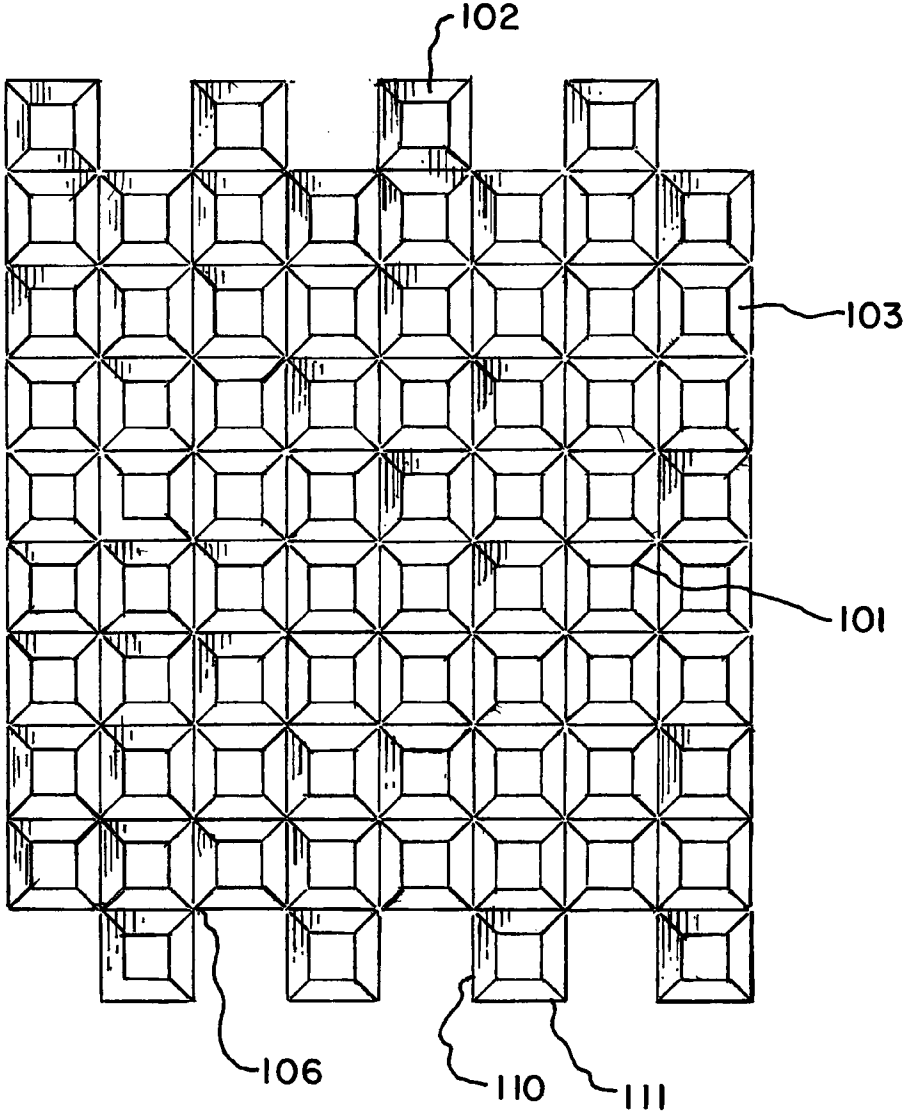
FIG. 3 is a view of a bottom side of the mat, according to the present invention.
Figure 4:
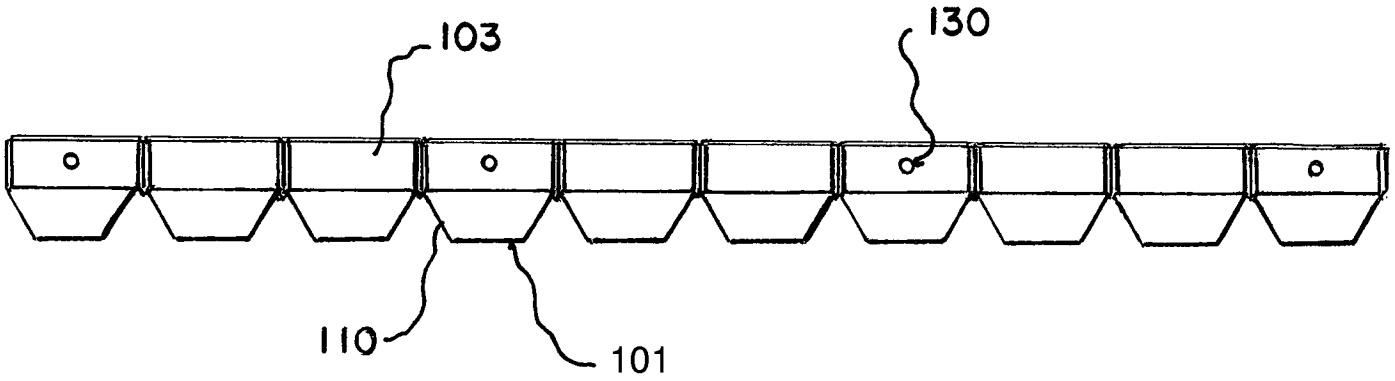
FIG. 4 is side view of a first side of the mat, according to the present invention.
Figure 5:
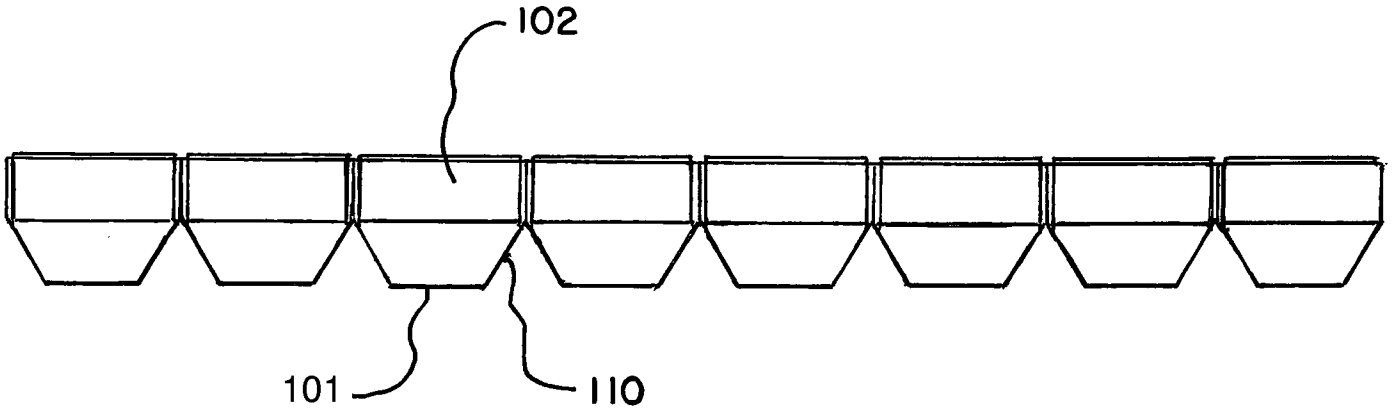
FIG. 5 is a side view of a second side of the mat, according to the present invention.
Figure 6:
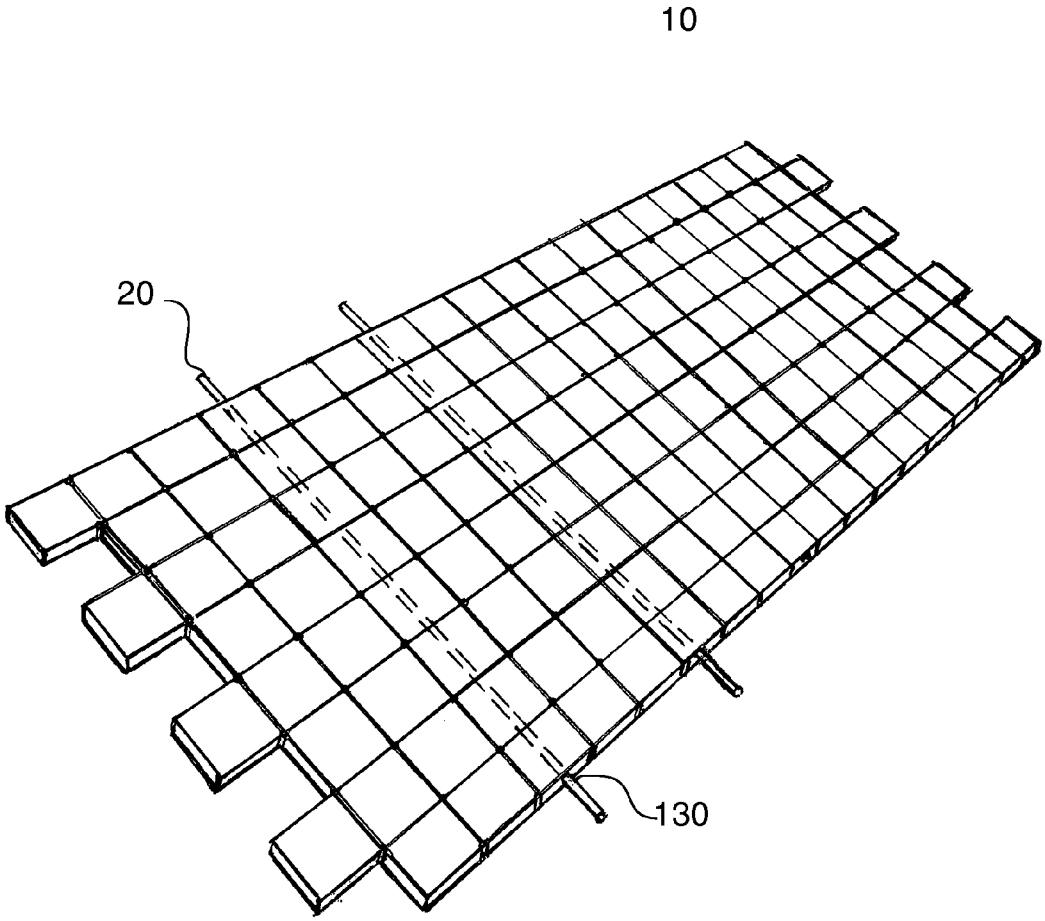
FIG. 6 is an isometric view of several mats assembled, according to the present invention.

Referring now to FIGS. 1-6, an interlocking pervious paving mat 10 adapted for installation onto a surface to provide a permeable paving solution. The paving mat 10 is designed to replace traditional paving methods such as concrete, asphalt, and paving block, with a permeable paving solution for the replacement of driveways, walkways, playground areas, and boat landing areas. The pervious mat 10 includes a top side 100, a bottom side 101, a pair of notched ends 102, and a pair of continuous ends 103. The mat 10 is constructed out of a grid of individual shapes 104 molded together. Each edge of the shape 104 includes a groove 105 with the corner of each shape 104 marking the location of an aperture 106. The aperture 106 is located within the groove 105 and extends a thickness of the mat 10 from the top side 100 to the bottom side 101. The aperture 106 allows water on the top side 100 to flow to the underside of the mat 10 and enter the ground below an installed mat 10. The grooves 105 facilitate the flow of water towards the apertures 106 and allow water to move off of the surface of the top side 100.

The pair of continuous ends 103 are configured on opposed sides of the mat 10 with the continuous ends 103 arranged adjacent to the notched ends 102. The pair of notched ends 102 are on opposed sides of the mat 10. The notched ends 102 are formed from an alternating of the grid pattern of the mat 10 with opposed notched ends 102 designed to intermesh in a cohesive pattern. In use, the notched ends 102 interlock together to allow for the attachment of multiple mats 10 together to form an integral and complete paving surface.

A plurality of through holes 130 are centrally located on the thickness of the mat 10 and extend a width of the mat 10 parallel to the notched ends 102. The through holes 130 are continuous throughout the width extending from each end of the pair of continuous ends 103. The through holes 130 are evenly spaced across the mat 10 dimensions and allow for the insertion of a fiberglass rod 20. In installation, the fiberglass rod 20 is fed into the through hole 130 of the mat 10 and any adjacent mats 10 stretching along a length of the installation area. Due to the extended length of the fiberglass rod 20 and its inherent material properties, the fiberglass rod 20 creates stability across mats 10 as they are installed.

The bottom side 101 of the mat 10 is formed from the underside of the shapes 104. The underside of the shapes 104 form a frustum with the bottom most point of the underside of the shapes flat with an area less than the area of the top side 100. The sides 110 are tapered to create this frustum shape. In appearance the bottom side 101 has a raised profile with large grooves forming an aggressive tread surface. The bottom side 101 frustum shape has the ability to grip the installation surface, provide increased flexibility, and aid in the permeability of the mat 10. Further, the frustum shape on the bottom side 101 of the mat 10, allows movement during frost/freeze/thaw cycles.

Preferably, the mat 10 is constructed out of a blend of recycled rubber and plastic materials and provided in a dimension of thirty-two (32) inches wide by forty (40) inches long. According to these dimensions, the mat 10 is comprised of a grid of square shapes 104 with a side length of four (4) inches. Although plastic and rubber are the preferred construction materials, the mat be enhanced by the addition of additional materials such as, fibers, sawdust, stone, or other recycled materials to enhance traction, de-icing, or weed control. Due to its permeable and recycled material properties, it is expected that the mat 10 would qualify for LEED (Leadership in Energy and Environmental Design) credits.

To install the mat 10, the surface to be paved is prepared. This preparation may consist of leveling the ground to be paved and first laying a surface of a coarse compacted substrate, such as class 5 gravel or recycled concrete. The appropriate number of mats 10 to cover the given area is selected. The mats 10 are then installed by interlocking the notched ends 102 and aligning the through holes 130. The fiberglass rods 20 are then threaded into the through holes 130 and cut to the appropriate length. The mat 10 structure is then placed onto the underlying surface with the bottom side 101 adjacent to the underlying surface.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) but that the invention will include all embodiments falling with the scope of the claims.

What is claimed is:

1. A permeable paving mat for placement onto a surface, the permeable paving mat comprising:

a top side, the top side having a substantially solid and continuous surface, the surface having a plurality of grooves, the grooves defining a border of a defined shape and representing an indentation in the surface, the grooves in communication with a plurality of apertures, the apertures located and spaced equidistant within the grooves and extending a thickness of the mat from the top side to a bottom side, wherein the apertures allow for the flow of surface water to an underside of the mat;

the bottom side, the bottom side opposite the top side and in communication with the surface, the bottom side being formed from a plurality of frustum shaped sections, the frustum shaped sections forming a profile resembling a tread surface, wherein the tapered nature of the frustum shaped sections form gaps for the transfer of water through the mat and onto the surface;

a pair of notched ends, each of the notched ends on opposed sides of the mat, each of the notched ends having a defined gap, the gaps spaced alternately on each opposed sides, wherein the notched ends are configured to intermesh when placed adjacent to an opposed side of the notched end of an additional mat;

a pair of continuous ends, the continuous end defining an edge of the width of the mat, the continuous ends each having a through hole, the through holes centrally located on the thickness of the mat, the through holes extending the width of the mat; and a rod, the rod sized for receipt within the through hole, wherein the rod is placed into the through hole to secure an adjoining mat along the continuous end.

2. A permeable paving mat as in claim 1, wherein the shape is square, the square defining a grid pattern on the top side surface, the grooves formed on the edges of the square shape, the plurality of apertures located at each corner of the square shape.

3. A permeable paving mat as in claim 1, wherein the rod is a fiberglass rod having flexibilty.

4. A permeable paving mat as in claim 1, wherein the mat is constructed out of recycled rubber and plastic materials.

5. A permeable paving mat for placement onto a surface, the permeable paving mat comprising:

a top side, the top side having a substantially solid and continuous surface, the surface having a plurality of grooves, the grooves defining a border of a square shape and forming a grid like pattern the grooves representing an indentation in the surface and the grooves in communication with a plurality of apertures, the apertures located within the grooves at a corner of each square and extending a thickness of the mat from the top side to a bottom side, wherein the apertures allow for the flow of surface water to an underside of the mat;

the bottom side, the bottom side opposite the top side and in communication with the surface, the bottom side being formed from a plurality of square frustum shaped sections, the square frustum shaped sections forming a profile resembling a tread surface, wherein the tapered nature of the frustum shaped sections form gaps for the transfer of water through the mat and onto the surface;

a pair of notched ends, each of the notched ends on opposed sides of the mat, each of the notched ends having a gap defined by the absence of a square shape, the gaps spaced alternately on each opposed sides, wherein the notched ends are configured to intermesh when placed adjacent to an opposed side of the notched end of an additional mat;

a pair of continuous ends, the continuous end defining an edge of the width of the mat, the continuous ends each having a through hole, the through holes extending the width of the mat and centrally located on the thickness of the mat; and a rod, the rod sized for receipt within the through hole, wherein the rod is placed into the through hole to secure an adjoining mat along the continuous end.

6. A permeable paving mat as in claim 5, wherein the rod is a fiberglass rod having flexibility.

7. A permeable paving mat as in claim 5, wherein the mat is constructed out of recycled rubber and plastic materials.

8. A method of installing a permeable paving mat of claim 1 onto a surface, the permeable paving mat having a through hole extending along its width, the through hole sized to receive a rod, the method comprising:

placing the paving mats onto an installation surface;

aligning the through holes of adjoining mats along this installation surface; and placing the rod into the through holes of adjoining mats to secure adjoining mats together.

* * * * *